US008191242B1

(12) United States Patent
Liang

(10) Patent No.: US 8,191,242 B1
(45) Date of Patent: Jun. 5, 2012

(54) PUNCH-DOWN DEVICE

(76) Inventor: Yu-Tai Liang, New Taipei (TW)

( * ) Notice: Subject to any disclaimer, the term of this patent is extended or adjusted under 35 U.S.C. 154(b) by 0 days.

(21) Appl. No.: 13/064,842

(22) Filed: Apr. 20, 2011

(51) Int. Cl.
*H01R 43/01* (2006.01)

(52) U.S. Cl. ..... 29/749; 29/750; 29/752; 29/755; 29/757; 29/758

(58) Field of Classification Search ..... 29/748, 29/750, 752, 757, 758, 754, 755, 753, 751, 29/749
See application file for complete search history.

(56) References Cited

U.S. PATENT DOCUMENTS 3,877,771 A * 4/1975 Jensen et al. ..... 29/752
3,944,163 A * 3/1976 Hayashi et al. ..... 242/382.1
4,048,710 A * 9/1977 Nijman ..... 29/566.4
4,870,747 A * 10/1989 Maack et al. ..... 29/753
7,222,415 B2 * 5/2007 Kinoshita et al. ..... 29/747
* cited by examiner

*Primary Examiner* — Livius R Cazan
(74) *Attorney, Agent, or Firm* — Bacon & Thomas, PLLC

(57) ABSTRACT

A punch-down device includes a housing, a driving mechanism, and at least one punch-down member. The housing forms therein hollow channels. The driving mechanism includes a rotation shaft and at least one rotary wheel, which is connected and supported by the rotation shaft at a top portion of the housing. The rotation shaft has an end extending outside the housing to form a coupling section. Each of the rotary wheels has a surface forming two tracks and two pegs. The two pegs of one rotary wheel are received in the two tracks of an adjacent one of the rotary wheels. The punch-down member is received in the hollow channels to correspond to the rotary wheels and be driven to move by the rotary wheels. The punch-down member has lower ends forming conductor depression sections. As such, the punch-down device carries out an operation of punching down and depressing conductors, whereby the efficiency of punch-down operation is increased and the operation is easy and reliable positioning is achieved.

10 Claims, 8 Drawing Sheets

PUNCH-DOWN DEVICE

FIELD OF THE INVENTION

The present invention relates to a punch-down device, which is applicable to an assembling operation of patch panel of an electronic apparatus to fit conductors of telecommunication cables arranged inside the electronic apparatus into terminal seats formed on the patch panel.

BACKGROUND OF THE INVENTION

A conventional telecommunication apparatus is often provided with a patch panel that forms two rows of multiple terminal seats along two side edges thereof, between which a channel is formed to receive the extension of telecommunication cables therethrough. Each terminal seat comprises a plurality of insertion slots each receiving and retaining therein a metal terminal electrically connected to the patch panel. Each telecommunication cable is associated with one terminal seat and each telecommunication cable comprises a plurality of internal conductors. The conductors are respectively associated with the insertion slots of the terminal seat to electrically couple to the metal terminals received in the insertion slots, so that electrical signals can be transmitted through the conductors arranged inside the telecommunication apparatus and the metal terminals of the terminal seats to the patch panel to be subsequently transmitted by external cables connected to the patch panel.

However, the number of the insertion slots of the terminal seats is great. An impact and punch down tool is often used to force the conductors into the corresponding insertion slots one by one to allow a sharp end of the metal terminal to pierce through an insulation cover of the conductor to form electrical connection. Each patch panel is often provided with a number of the terminal seats. The more the terminal seats are formed on the patch panel, the more time it needs for such a punch-down operation. This consumes time and increases the costs.

Further, the insertion slot of the terminal seat has a narrow opening, making it hard to precisely fit the conductor into the insertion slot, which leads to repeated punch-down operation and the punch-down operation may not be effective and reliable. Further, improper application force occurring in the punch-down operation may cause damage of the structure of an opposite end of the metal terminal.

In view of such problems, the present invention aims to provide a punch-down device that is capable of simultaneously depressing conductors in a successive fashion so as to increase the efficiency of punch-down operation with easy operation and precise, effective, and reliable positioning.

SUMMARY OF THE INVENTION

An objective of the present invention is to provide a punch-down device that carries out an operation of punching down and depressing conductors in a successive fashion.

Another objective of the present invention is to provide a punch-down device that simultaneously cuts off excessive length of conductor to thereby make the operation easy and realize effective positioning.

To achieve the above objectives, the present invention provides a punch-down device, which comprises: a housing, which forms therein hollow channels; a driving mechanism, which comprises a rotation shaft and at least one rotary wheel, which is connected and supported by the rotation shaft at a top portion of the housing, the rotation shaft having an end extending outside the housing to form a coupling section, each of the rotary wheels having a surface forming two tracks and two pegs, the two pegs of one rotary wheel being received in the two tracks of an adjacent one of the rotary wheels; and at least one punch-down member, which is received in the hollow channels to correspond to the rotary wheels and be driven to move by the rotary wheels, the punch-down member having lower ends forming conductor depression sections. As such, the punch-down device carries out an operation of punching down and depressing conductors, whereby the efficiency of punch-down operation is increased and the operation is easy and reliable positioning is achieved.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
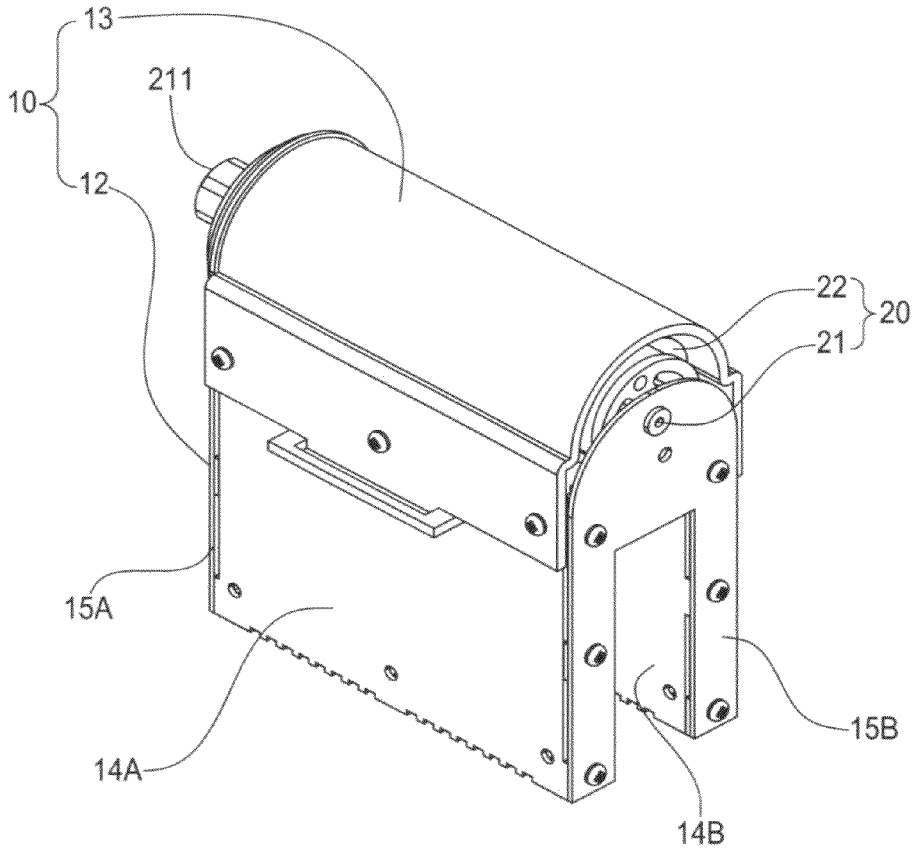
FIG. 1 is a perspective view of a punch-down device according to the present invention.

With reference to the drawings and in particular to FIGS. 1-4, the present invention provides a punch-down device, which comprises a housing 10, a driving mechanism 20, and at least one punch-down member 30 (multiple punch-down members being visible in the drawings).

The housing 10 forms therein hollow channels 11. The driving mechanism 20 comprises a rotation shaft 21 and at least one rotary wheel 22 (multiple rotary wheels being visible in the drawings). The rotary wheels 22 are connected in cascade to the rotation shaft 21 and arranged in a top portion of the housing 10. The rotation shaft 21 has an end extending outside the housing 10 to form a coupling section 211. Each rotary wheel 22 has a surface forming two tracks 221 and two pegs 222, so that the two pegs 222 of the rotary wheel 22 are received in the two tracks defined in an adjacent rotary wheel 22. The punch-down members 30 are movably received in the hollow channels 11 to correspond in position to the rotary wheels 22 to be driven by the rotary wheels 22 for movement. The punch-down member 30 has lower ends forming conductor depression sections 31.

In the embodiment illustrated, among the rotary wheels 22, one rotary wheel 22 is formed in such a way that the two tracks 221 thereof are arranged, in a symmetrical manner, at upper and lower portions thereof, while an adjacent rotary wheel 22 is formed in such a way that the two tracks 221 are arranged opposite diagonally and symmetrical. This arrangement allows the one rotary wheel, after having rotated by a predetermined angle, to drive the adjacent rotary wheel to rotate (see FIG. 4). This helps flexibly adjusting the wire punch-down operation and stroke carried out by each of the rotary wheels.

Since a patch panel 80 (see FIG. 6) forms a plurality of terminal seats 81 along each side edge thereof and since the terminal seats of the same side edge are arranged in a spaced manner, gaps G are present in the plurality of terminal seats. To align each of the punch-down members 30 with an insertion slot 82 of each terminal seat 81, 81', as shown in FIG. 3, the present invention provides a driving mechanism 20 that comprises at least one positioning wheel 23 (multiple positioning wheels being visible in the drawings) The positioning wheels 23 are penetrated by the rotation shaft 21 and are arranged, in a spaced manner, among the rotary wheels 22 to respectively correspond in position to the gaps G among the terminal seats thereby ensuring each of the punch-down members may reliably engage and thus depress the internal conductor. Each of the positioning wheels 23 is provided, on a surface thereof, with a corresponding structure 231 (see FIG. 2) to mate the tracks 221 or the pegs 222 of one of the rotary wheels 22 adjacent thereof. As such, each positioning wheel is rotatable in unison with the adjacent the rotary wheel.

The housing 10 comprises a housing base 12 and a housing cover 13. The housing cover 13 is coupled to the housing base 12. The channels 11 are formed in the housing base 12. Each punch-down member 30 comprises a body 301 and two legs 302, 303. The two legs 302, 303 are mounted to opposite side portions of a lower end of the body 301. Each of the two legs has a lower end forming a conductor depression section 31. The punch-down member 30 is arranged to straddle on the terminal seats 81, 81' of the two side edges of the patch panel 80 (see FIG. 4) to perform simultaneous conductor depression operations thereby making the operation convenient and reducing the operation time. Further, the two legs 302, 303 define therebetween a hollow space that corresponds to a channel formed in a central portion of the patch panel 80 thereby facilitating adjustment and extension of a plurality of telecommunication cables 90 therethrough.

Figure 2:
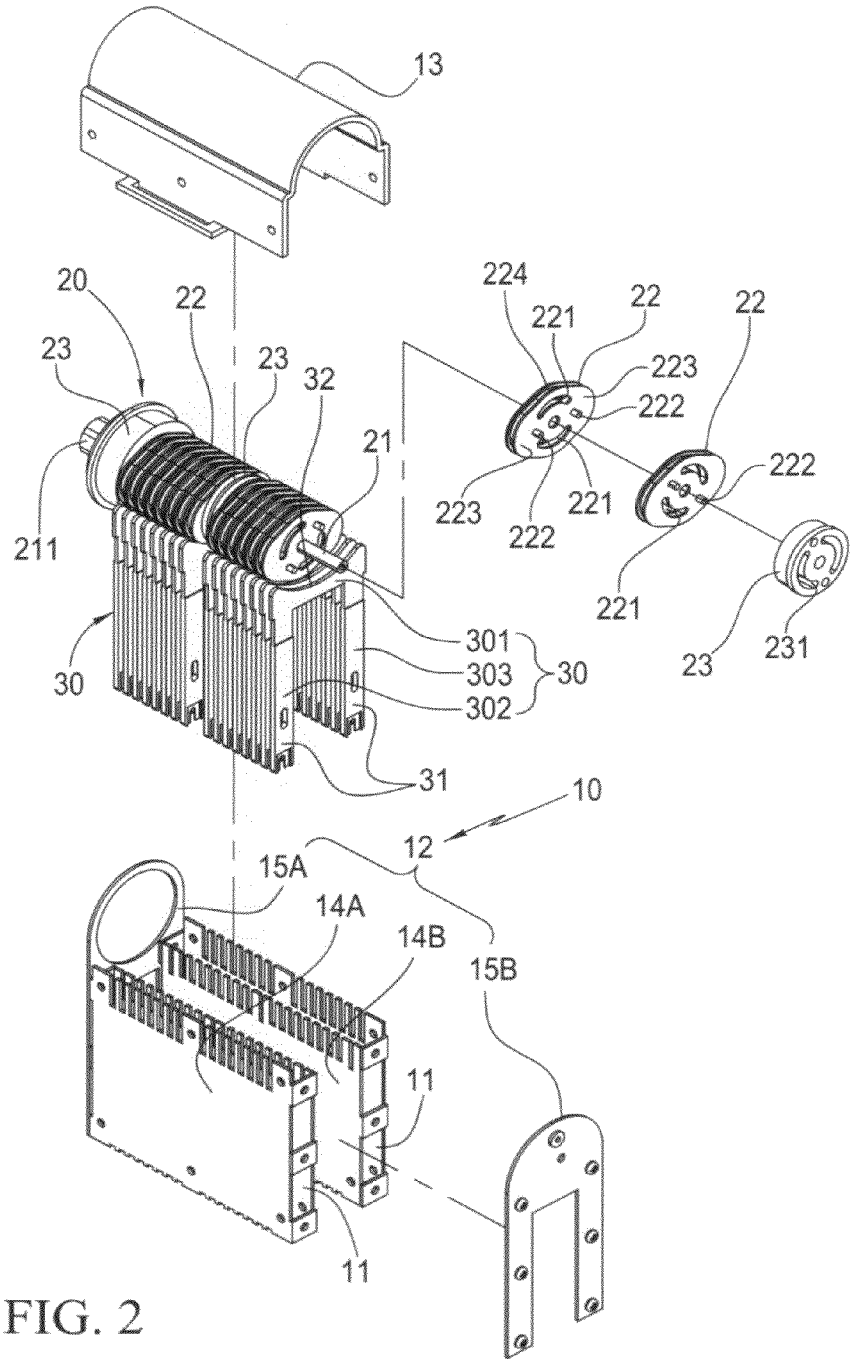
FIG. 2 is an exploded view of FIG. 1.
Figure 2A:
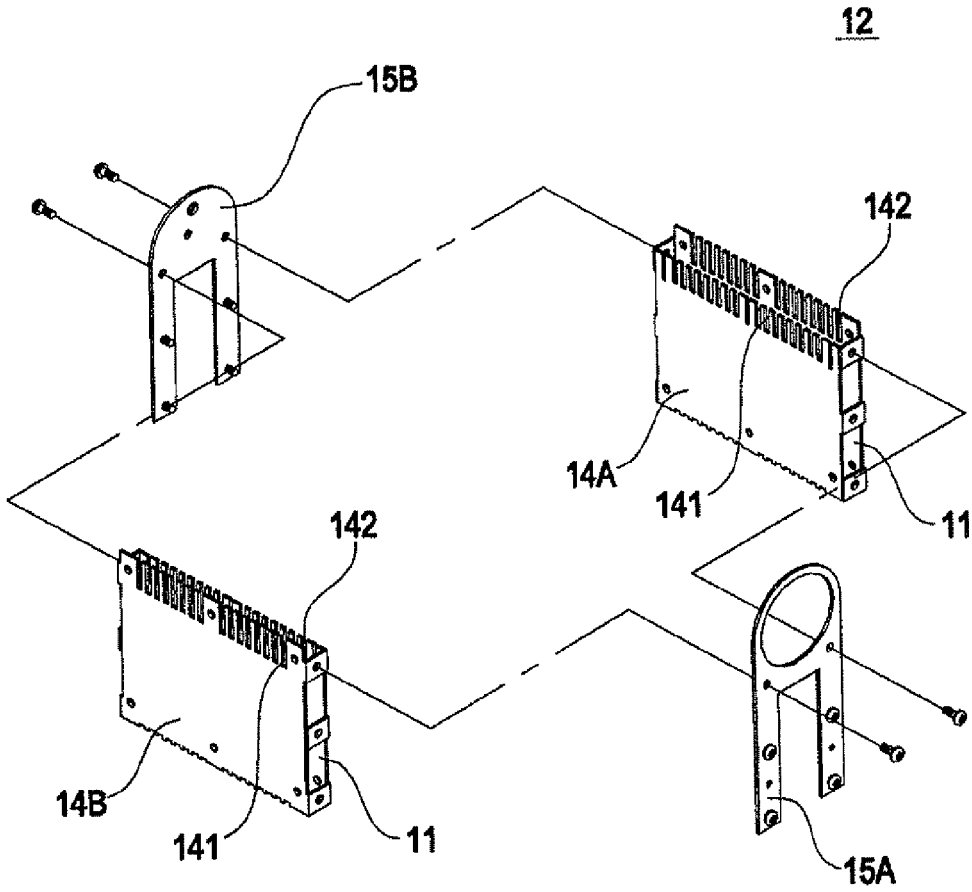
FIG. 2A is an exploded view of a housing based shown in FIG. 2.
Figure 3:
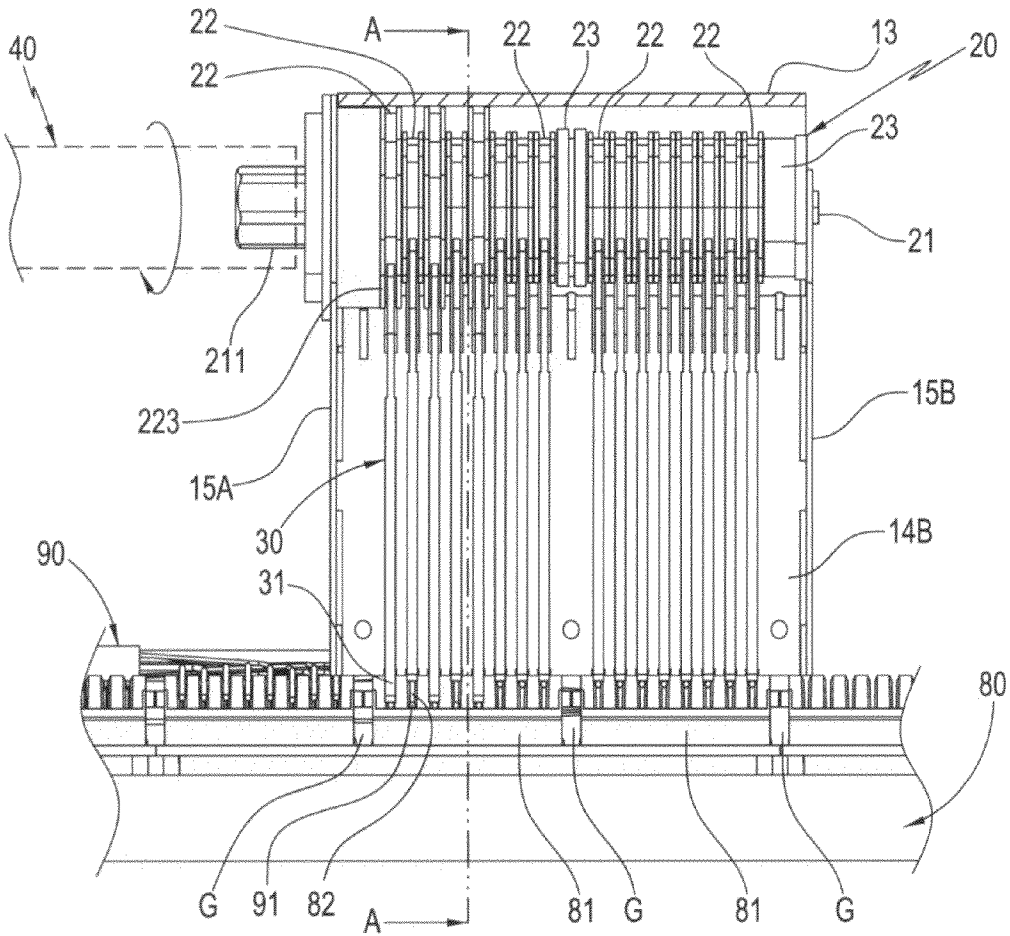
FIG. 3 is a left side view of the punch-down device of FIG. 1 coupled to a patch panel.

Referring to FIGS. 2 and 2A, the housing base 12 is composed of two frames 14A, 14B and two connection boards 15A, 15B. The two frames 14A, 14B are respectively arranged under two side portions of a lower surface of the housing cover. The two connection boards 15A, 15B are respectively connected to opposite ends of the two frames 14A, 14B, making the housing base 12 showing a loop-like configuration. The two frames 14A, 14B define the channels 11 therein to movably receive the two legs 302, 303 of each punch-down member 30 therein (see FIG. 4).

Figure 4:
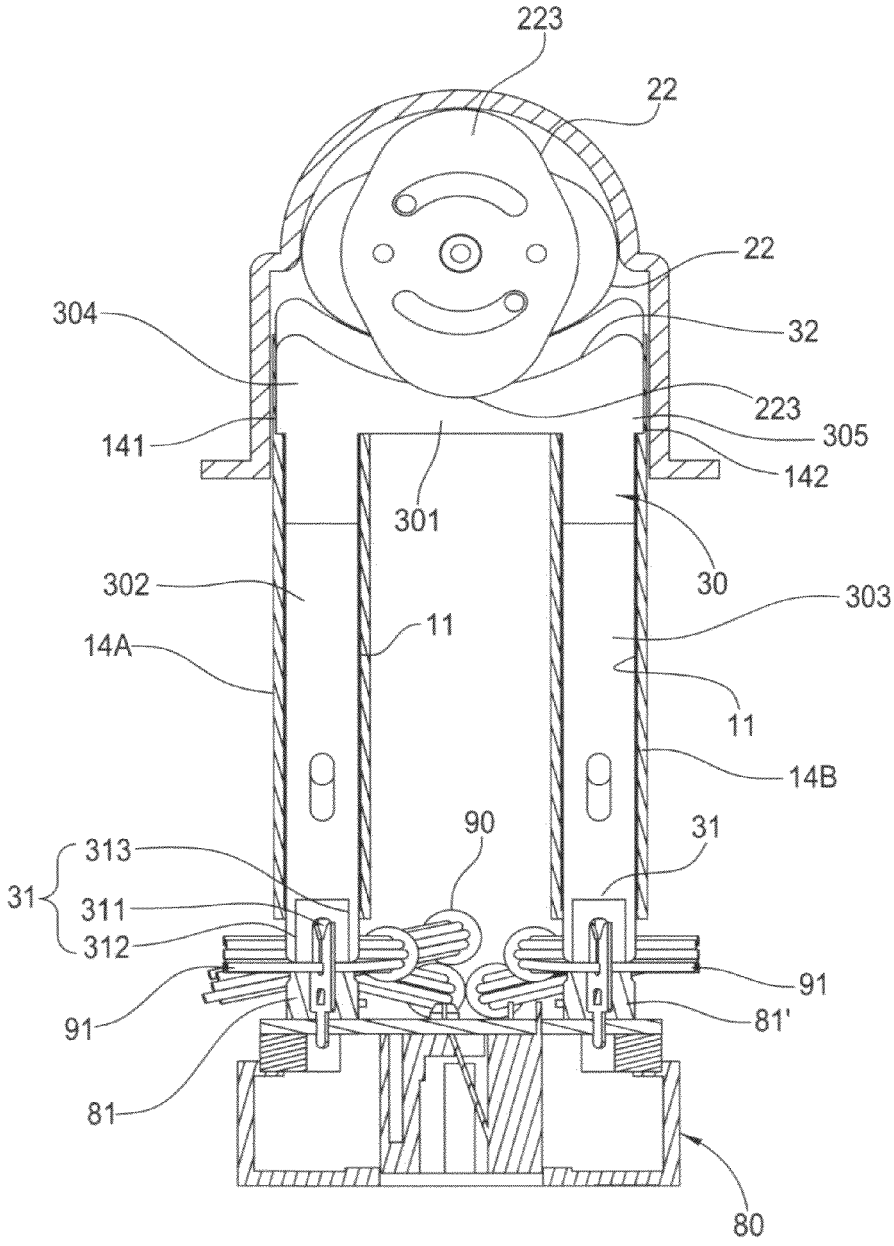
FIG. 4 is a cross-sectional view taken along line A-A of FIG. 3.

The operation of the punch-down device will be described with reference to FIG. 3 (in which the side frame 14A of FIG. 1 is removed and the housing cover 13 is shown in sectioned form to illustrate the operations of the driving mechanism 20 and the punch-down members 30). An operation unit 40 is first coupled to the coupling section 211 and the operation unit 40 can be a manually-operated hand tool (such as socket wrench) or an automatic tool (such as an electrical motor) that drives rotation of the rotation shaft 21. Each rotary wheel 22 forms at least one camming structure 223, and each punch-down member 30 has a top end forming a corresponding structure 32. In the embodiment illustrated, as shown in FIG. 4, each rotary wheel 22 forms two camming structures 223 at opposite side edges thereof, but the present invention is not limited to camming structure formed on the two side edges. When a rotary wheel 22 rotates, the camming structure 223 thereof pushes against the corresponding structure 32 of the punch-down member 30, forcing the two legs 302, 303 of the punch-down member 30 downward to have the recesses 311 of the conductor depression sections 31 tightly engage internal conductors 91. With wire hold-down structures 312, 313 formed on opposite sides of each of the recesses 311, the internal conductors 91 positioned on the terminal seats 81, 81' of the two side edges of the patch panel 80 are forcibly depressed into the corresponding insertion slots.

Afterwards, the rotation shaft 21 continuously rotates, and as shown in FIG. 3, successively causes the adjacent, next rotary wheel 22 to rotate and carry out the same operation as the previous rotary wheel 22 to make the associated punch-down member 30 depressing the internal conductor 91 located below into the insertion slot 82, and then subsequently causes the remaining rotary wheels 22 to rotate and drive the corresponding punch-down member 30 in a one by one fashion. The rotary wheels 22 that have been rotated will continuously rotate to have the punch-down members 30 repeating the conductor depression operations so as to reliably depress the internal conductors into the insertion slots. After the rotary wheels 22 of the driving mechanism 20 have all been rotated, the rotation shaft 21 is rotated in a reversed direction to return the rotary wheels 22 back to the original locations to further perform conductor depression operations on other terminal seats and internal conductors.

Further, according to the present invention, each rotary wheel 22 has a circumferential surface forming a circumferential groove 224 for receiving and guiding the corresponding structure 32 of the punch-down member 30, so as to help stabilizing the movement of the punch-down member 30 caused by the rotation of the rotary wheel 22.

Figure 5:
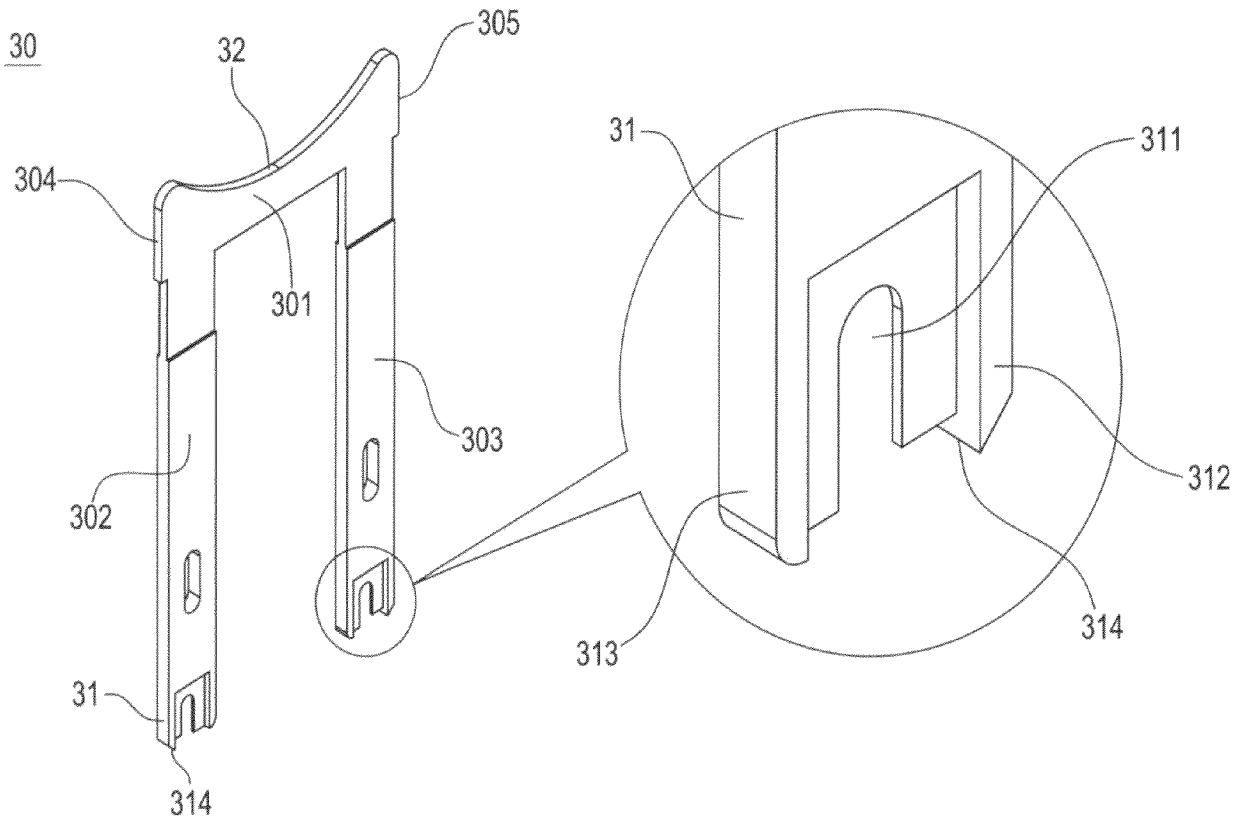
FIG. 5 is a perspective view of a punch-down member shown in FIG. 2 and a magnified view of a conductor depression section of the punch-down member.

Referring to FIGS. 4 and 5, the conductor depression section 31 forms in a central portion thereof a recess 311 and also forms two wire hold-down structures 312, 313 on opposite side portions of the conductor depression section 31. The wire hold-down structures 312, 313 are made in the form of post and each has a lower end that forms a blunt surface to facilitate engagement between the conductor depression section 31 and the insertion slot of the terminal seat, so that the internal conductor 91 can be securely fit into a metal terminal received in the insertion slot. According to the present invention, the conductor depression section and the leg are integrally formed together, but they can be arranged in a detachable structure.

Each punch-down member 30 forms two stop blocks 304, 405 on opposite sides of the body 301. Each frame 14A, 14B has two opposing side walls each forming at least one elongate slit 141, 142 to receive and guide movement of the stop blocks 304, 305 therein and to provide a function of limiting the movement, so that each punch-down member 30 is kept in a movement range of predetermined linear path for reciprocal motion.

Referring to FIG. 5, the wire hold-down structure 312 of the conductor depression section 31 forms in a lower end thereof a cutting edge 314. In this way, during a punch-down operation, as shown in FIG. 7, the cutting edge 314 may simultaneously cut off excessive length of internal conductor 91 that extends outside the terminal seat 81, 81' so as to save the time required for trimming.

Figure 6:
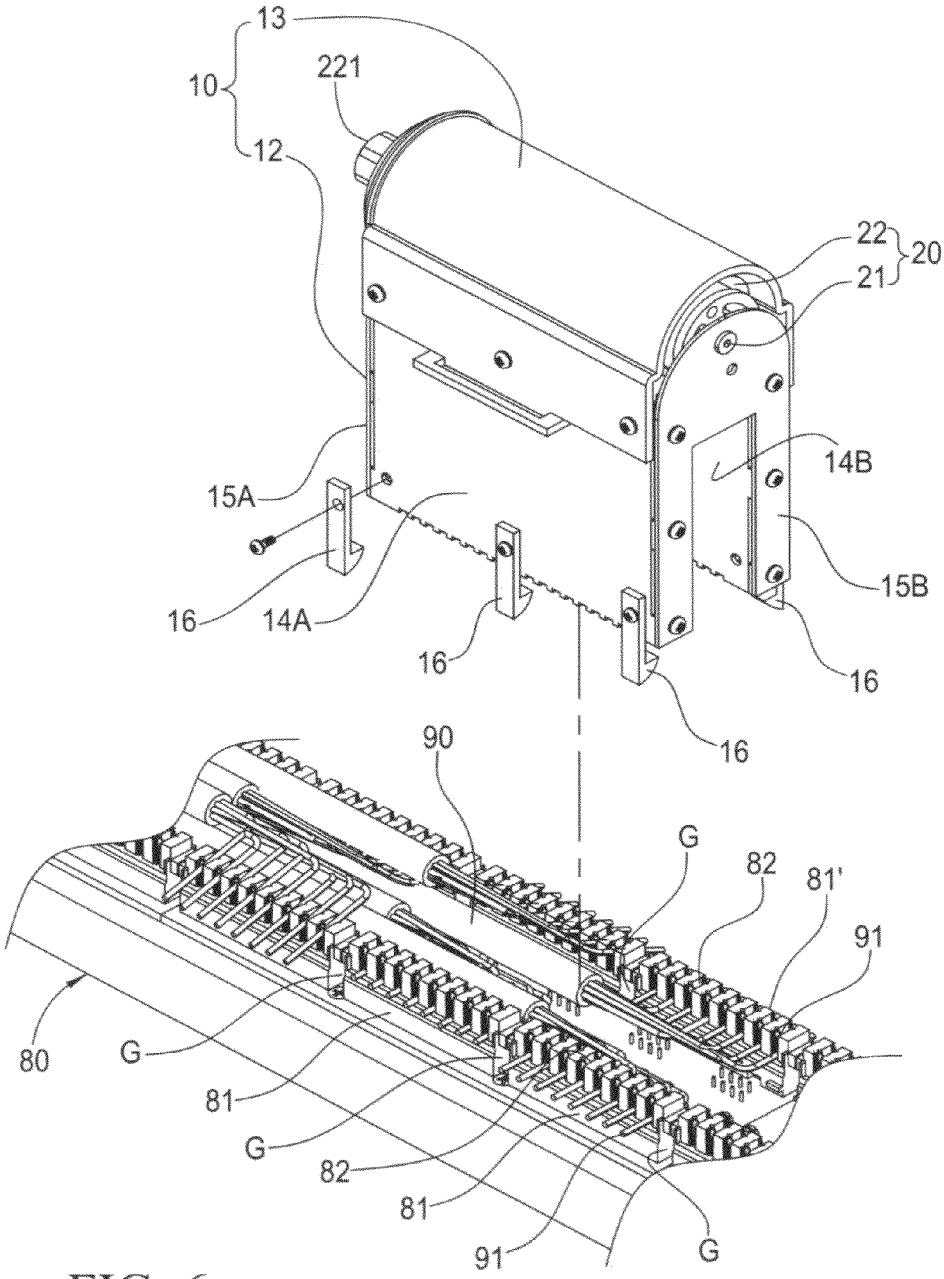
FIG. 6 is a perspective view showing the punch-down device of FIG. 1 being provided with a retention structure, a patch panel being also shown.
Figure 7:
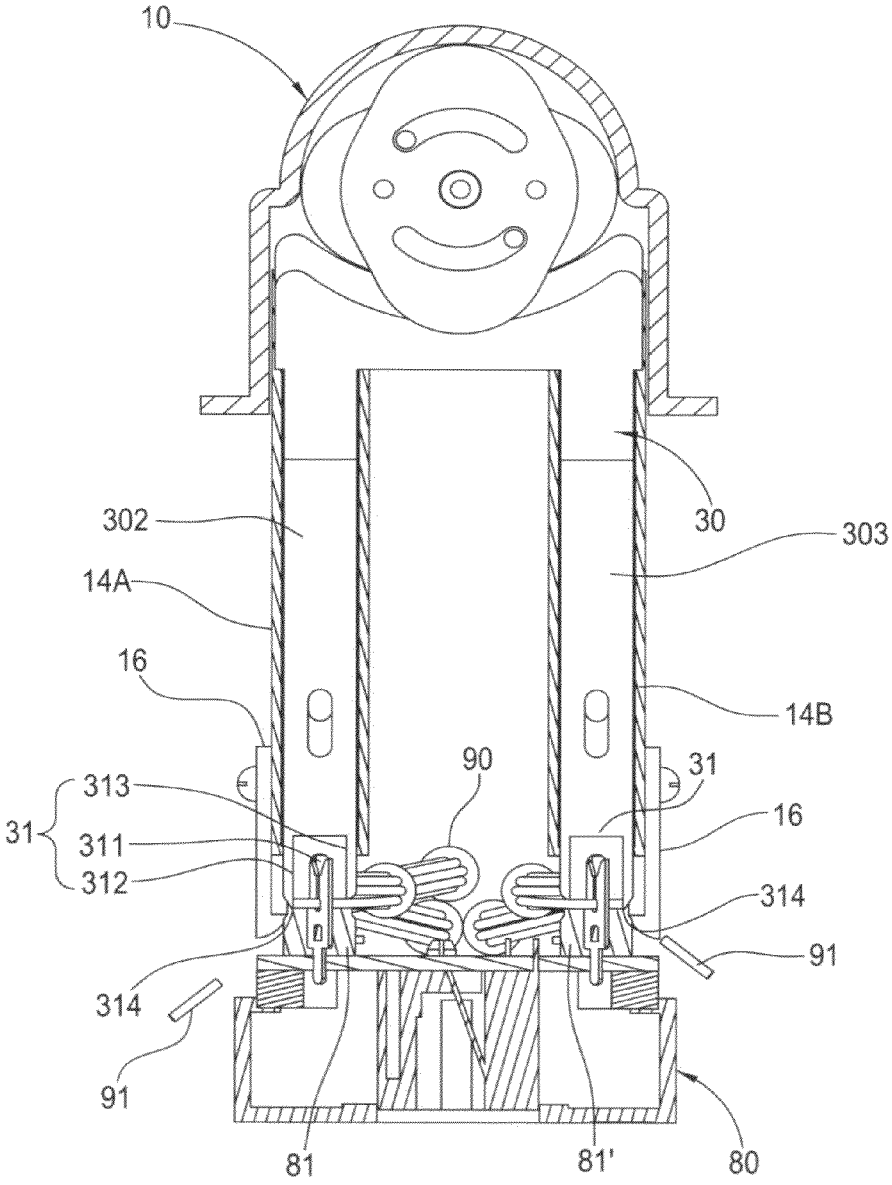
FIG. 7 is a cross-sectional view showing the punch-down device of FIG. 6 coupled to terminal seats of the patch panel.

Referring to FIGS. 6 and 7, the housing 10 forms, in a lower end thereof, a retention structure 16 for coupling and positioning purposes. In the embodiment illustrated, the retention structure 16 is mounted to the lower ends of the side surfaces of the two frames 14A, 14B of the housing 10 to couple the punch-down device to the patch panel 80. The retention structure 16 are received and engage the gaps G among the terminal seats 81, 81' so that the conductor depression sections 31 can be in precise alignment with the insertion slots 82 to perform reliable punch-down operation.

As such, the present invention provides a punch-down device that comprises a combination of a housing, a driving mechanism, and at least one punch-down member to perform simultaneous conductor depression operations in a successive fashion so that a plurality of internal conductors can be punched down and depressed into insertion slots of the respective terminal seats. Thus, the efficiency of punch-down operation is increased and the operation of the punch-down device according to the present invention is easy and may provide an effective positioning function.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A punch-down device, comprising:

a housing, which forms therein hollow channels;

a driving mechanism, which comprises a rotation shaft and a plurality of rotary wheels, the rotary wheels being connected to and supported by the rotation shaft in a top portion of the housing, the rotation shaft having an end extending outside the housing to form a coupling section, each of the rotary wheels having a surface forming two tracks and two pegs, so that the two pegs of the rotary wheel are received in the two tracks defined in an adjacent one of the rotary wheels; and a plurality of punch-down members, each punch-down member being received in a hollow channel associated with a corresponding rotary wheel and being driven to move by the rotary wheel, and the punch-down members having lower ends forming conductor depression sections.

2. The punch-down device as claimed in claim 1, wherein among the rotary wheels, one of the rotary wheels is formed in such a way that the two tracks thereof are arranged, in a symmetrical manner, at upper and lower portions thereof, while an adjacent one of the rotary wheels is formed in such a way that the two tracks are arranged opposite diagonally and symmetrical, whereby the one rotary wheel, after having rotated by a predetermined angle, drives the adjacent rotary wheel to rotate.

3. The punch-down device as claimed in claim 1, wherein the driving mechanism comprises a plurality of positioning wheels, the positioning wheels being penetrated by the rotation shaft and arranged in a spaced manner among the rotary wheels, each of the positioning wheels being provided on a surface thereof with a corresponding structure to mate the tracks or the pegs of the rotary wheels.

4. The punch-down device as claimed in claim 1, wherein the housing comprises a housing base and a housing cover, the housing cover being coupled to the housing base, the hollow channels being formed in the housing base, each of the punch-down members comprising a body and two legs, the two legs being mounted to opposite side portions of a lower end of the body, each of the two legs having a lower end forming a conductor depression section.

5. The punch-down device as claimed in claim 4, wherein the housing base comprises two frames and two connection boards, the two frames being respectively arranged under side portions of a lower surface of the housing cover, the two connection boards being respectively connected to opposite ends of the two frames, and the two frames defining the hollow channels therein to movably receive the two legs of each punch-down member therein.

6. The punch-down device as claimed in claim 5, wherein each of the punch-down members forms two stop blocks on opposite sides thereof, each of the frames having two opposing side walls each forming at least one elongate slit to receive and guide movement of the stop blocks therein and to provide a function of limiting the movement.

7. The punch-down device as claimed in claim 1, wherein each of the rotary wheels forms at least one camming structure and each of the punch-down members has a top end forming a corresponding structure, each of the rotary wheels having a circumferential surface forming a circumferential groove for receiving and guiding the corresponding structure of the punch-down member therein.

8. The punch-down device as claimed in claim 1, wherein the conductor depression section forms in a central portion thereof a recess and also forms two wire hold-down structures on opposite side portions of the conductor depression section.

9. The punch-down device as claimed in claim 8, wherein the conductor depression section forms a cutting edge on a lower end of one of the wire hold-down structures.

10. The punch-down device as claimed in claim 1, wherein the housing forms in a lower end thereof a retention structure for coupling and positioning the housing to a patch panel.

* * * * *